United States Patent [19]

Lovatt

[11] 4,167,391

[45] Sep. 11, 1979

[54] DUST TRAP

[75] Inventor: William J. Lovatt, Stoke on Trent, England

[73] Assignee: Acme Marls Limited, England

[21] Appl. No.: 841,455

[22] Filed: Oct. 12, 1977

[30] Foreign Application Priority Data

Oct. 15, 1976 [GB] United Kingdom ..... 42863/76

[51] Int. Cl.[2] ..... F27D 5/00

[52] U.S. Cl. ..... 432/258

[58] Field of Search ..... 432/258, 259, 5

[56] References Cited

U.S. PATENT DOCUMENTS

| | | | |
|---|---|---|---|
| 2,923,997 | 2/1960 | Emmerling | 432/58 |
| 3,997,289 | 12/1976 | Bowers | 432/258 |

FOREIGN PATENT DOCUMENTS

| | | | |
|---|---|---|---|
| 254018 | 5/1967 | Austria | 432/258 |
| 601880 | 5/1948 | United Kingdom | 432/258 |

*Primary Examiner*—John J. Camby

*Attorney, Agent, or Firm*—Klarquist, Sparkman, Campbell, Leigh, Hall & Whinston

[57] ABSTRACT

A shelf support for a ceramic-ware support structure in which a transverse groove extends across the upper shelf supporting surface to provide a dust trap. The support is intended for use with movable shelves of refractory material and prevents quantities of ceramic dust from falling onto the ware supported by the structure when the shelves are slid into position. Additionally, chamfers are provided on the shelf support and the associated uprights of the structure to reduce the amount of dust abraded from the shelves during insertion and removal.

3 Claims, 4 Drawing Figures

FIG. 3
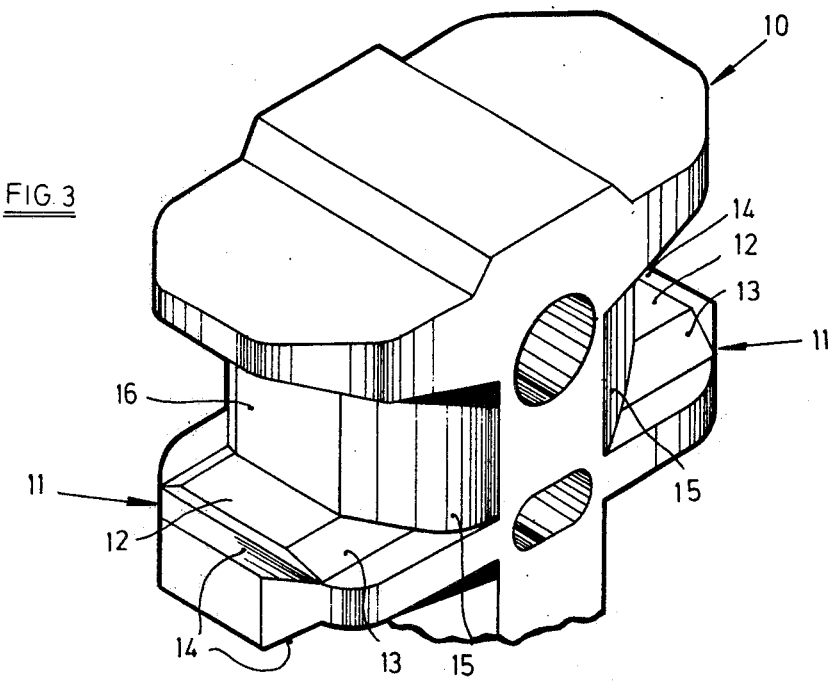
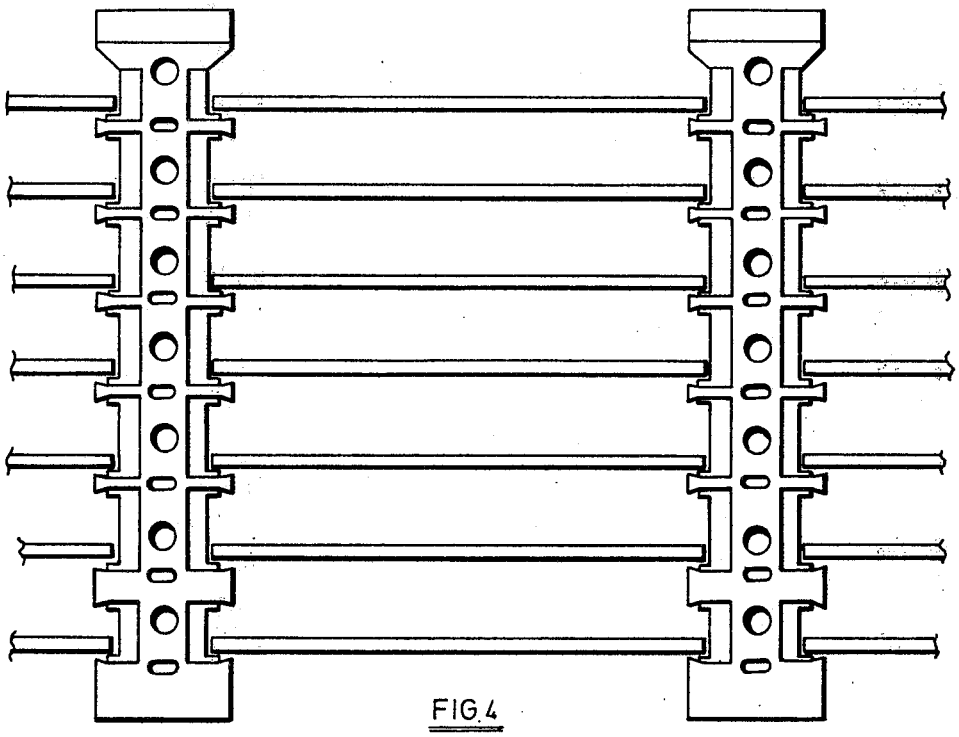
FIG. 4

DUST TRAP

BACKGROUND OF THE INVENTION

1. Field of the Invention

This invention relates to a support for ceramic-ware to be used during firing of the ware in a kiln. The term "ceramic-ware" includes all types of ceramic articles such as tiles, cook-ware and table-ware for example.

2. Description of Prior Art

Various ware supporting arrangements have been proposed and there has been a recent trend for the provision of adjustable shelves so that the basic ware support can be used efficiently for the firing of different types of ware of differing sizes.

In order to accommodate different sizes of ware, intermediate shelves are inserted by sliding onto shelf supports which are provided on or secured to uprights of the ware supporting structure.

There has been a problem that the insertion or removal of shelves tended to cause release of quantities of refractory dust owing to the abrasion of the shelf supports and the shelves themselves by mutual contact. The dust tended to fall on the ware and mar the surface, causing spotting or other imperfections.

SUMMARY OF THE INVENTION

It is an object of the invention to provide an improved shelf support and a ceramic-ware support structure for use in the firing of ceramic-ware, which reduces or overcomes this problem.

According to the invention there is provided, on or for fitment to an upright of a ceramic-ware support structure, a refractory shelf support adapted to extend generally horizontally in use and affording, on its upper side, a generally horizontal surface capable of supporting a shelf, the shelf support having a groove extending across at least the major part of said generally horizontal surface.

The support may have a free end remote from the upright and a pair of side edges extending from the free end towards the upright, one or both of the side edges having a chamfer leading directly onto said generally horizontal surface.

The underside of the shelf support may be identical in form to the upper side.

The invention also provides a ceramic-ware support structure comprising, in combination, a plurality of refractory uprights, each having formed integrally or assembled therewith a plurality of refractory shelf supports, each support extending generally horizontally away from the associated upright and having, on its upper side, a generally horizontal surface capable of supporting a shelf, a groove being provided extending across at least the major part of said generally horizontal surface.

The uprights of the support structure may have chamfers at least at positions adjacent the chamfers on the shelf supports.

BRIEF DESCRIPTION OF THE VIEWS OF THE DRAWINGS

The invention will now be described in more detail by way of example only with reference to the accompanying informal drawings in which:

FIG. 3 is an isometric view of part of the upright.

FIG. 4 is a perspective view, on a smaller scale, of a ceramic-ware support.

DETAILED DESCRIPTION

Figures 1, 2:
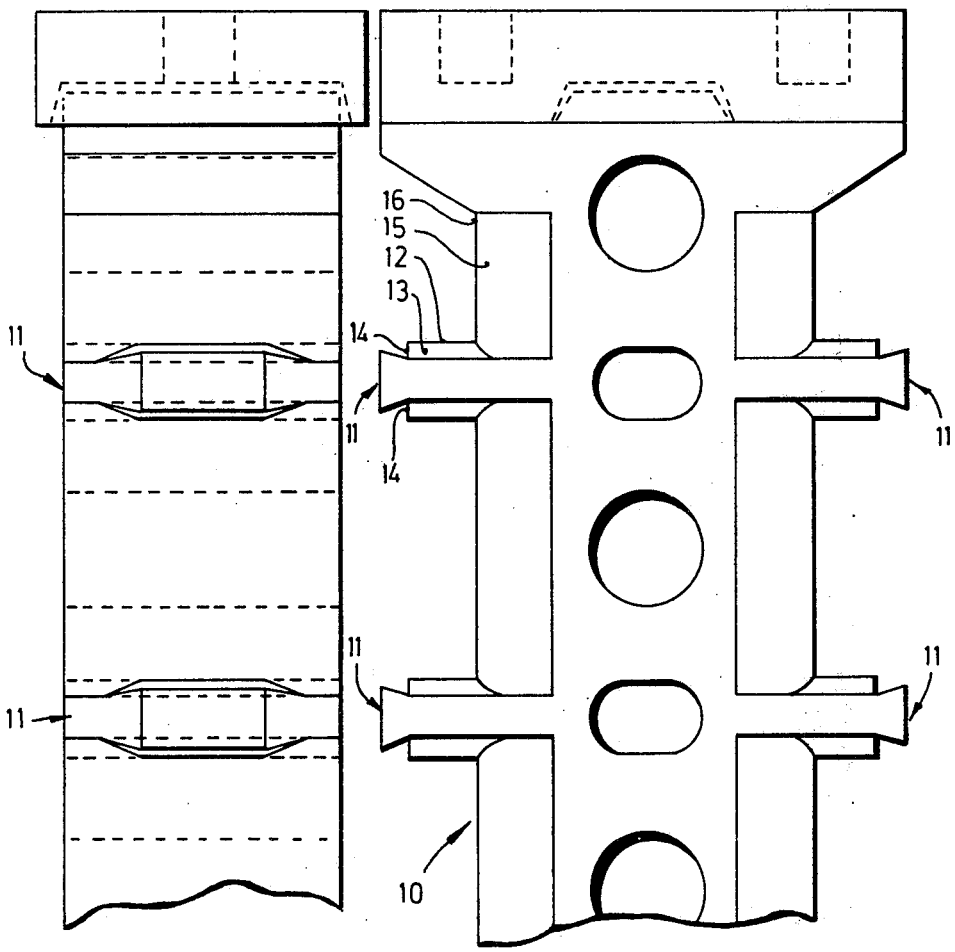
FIG. 1 is a side elevational view of an upright having integral shelf supports embodying the invention.
FIG. 2 is a front elevational view of the same upright.

The upright 10 shown in FIGS. 1 and 2 is made of refractory material and has a plurality of integrally formed shelf supports 11 extending generally horizontally outwardly from the upright.

Each shelf includes a flat horizontal top surface 12 which supports the shelf in use. At the edge of the shelf support on each side there is a chamfer 13 which leads smoothly into the horizontal surface 12. Both the upper and lower surfaces of the shelf support are provided with flat horizontal surfaces and chamfers so that the shelf support can be used in an inverted position.

Although shown as an integrally formed structure, an upright can be built up from separate elements, for example shelf supports and upright pillars, assembled loosely or cemented together.

At the free end of the shelf support, a deep V-shaped groove 14 is provided, extending across the entire width of the horizontal surface 12, as shown. The groove may, if preferred, extend across only a major part of the support, but should be of substantial volume for most effectiveness.

In use, a shelf is inserted so that its leading edge meets the chamfer 13 and it is then guided by the chamfer up on to the horizontal surface 12.

There is no sharp edge brought into contact with the underside of the shelf so there is a much reduced tendency for refractory dust to be scraped from the shelf. Any dust which is formed by friction between the shelf and the support tends to be distributed centrally on the support and gradually, over a period of use the dust builds up in the groove 14, from which it is prevented from falling onto the ware which may be situated on shelves below.

Periodically, the groove 14 can be cleaned by the use of a vacuum cleaner. If the support is frequently used for the firing of glazed ware, the glaze may form a coating which prevents the dust which has built up in the groove 14 from escaping.

The upright itself can be provided with a chamfer 15 so that the side edge of the shelf is not substantially abraded as the shelf is inserted. There is a smooth transition between the chamfer 15 and a substantially upright surface 16 which abuts the edge of the shelf in use.

I claim:

1. A ceramic ware support structure comprising a plurality of upright pillars provided with outwardly extending shelf supports adapted to slidably receive and support at least one horizontally disposed shelf, each shelf support having a flat, generally horizontal supporting surface and defining an upwardly opening dust trap groove located outwardly of and below the supporting surface.

2. A ceramic ware support structure according to claim 1 wherein each shelf support has at least one side edge extending from the associated pillar to a region remote therefrom, the edge being chamfered upwardly directly onto the supporting surface.

3. A ceramic ware support structure according to claim 2 wherein the pillars are chamfered at least at positions adjacent the chamfers on the shelf supports.

* * * * *